United States Patent [19]

Artunc et al.

[11] Patent Number: 4,965,916

[45] Date of Patent: Oct. 30, 1990

[54] MEANS FOR THE INTERLACING OF YARN

[75] Inventors: Hulusi Artunc, Pfullingen; Gerhard Egbers, Reutlingen; Helmut Weinsdörfer, Pliezhausen; Jürgen Wolfrum, Ebersbach, all of Fed. Rep. of Germany

[73] Assignee: Deutsche Institute fur Textil- und Faserforschung Stuttgart Stiftung des Offentlichenrechts, Dekendorf, Fed. Rep. of Germany

[21] Appl. No.: 348,698

[22] PCT Filed: Aug. 15, 1987

[86] PCT No.: PCT/EP87/00453

§ 371 Date: Apr. 5, 1989

§ 102(e) Date: Apr. 5, 1989

[87] PCT Pub. No.: WO89/01539

PCT Pub. Date: Feb. 23, 1989

[51] Int. Cl.[5] ..... D02J 1/08; D02G 1/16

[52] U.S. Cl. ..... 28/271; 28/272; 28/274; 57/333

[58] Field of Search ..... 57/333, 289, 350; 28/271–276

[56] References Cited

U.S. PATENT DOCUMENTS

| | | | |
|---|---|---|---|
| 3,574,249 | 4/1971 | Cannnon | 28/274 |
| 3,971,108 | 7/1976 | Gorrafa | 28/272 |
| 4,011,640 | 3/1977 | Keith | 28/274 |
| 4,069,565 | 1/1978 | Negishi et al. | 28/274 |
| 4,125,922 | 11/1978 | Irwin | 28/274 X |
| 4,240,188 | 12/1980 | Zoina | 28/275 X |
| 4,245,378 | 1/1981 | Price | 28/271 |
| 4,644,620 | 2/1987 | Maeda | 28/274 X |

*Primary Examiner*—John Petrakes

*Attorney, Agent, or Firm*—Herbert Dubno

[57] ABSTRACT

Interlacing means are provided for the interlacing of multifilament yarns exhibiting a yarn channel. At given distances from the entrance and exit openings forming the yarn channel, yarn guides are so arranged that, with the supply of compressed air shut off, the yarn is laid onto the yarn channel so that it extends parallel to its longitudinal direction, and that the straight yarn sections, which are located between the entrance and exit openings of the yarn channel and the yarn guides, are inclined at acute angles to portions of the geometric longitudinal axis of the yarn channel. Furthermore, the blow angle of the blow nozzle is smaller than 90°. The length of the yarn channel equals for smooth yarns maximally 40 mm and for texturized yarns maximally 30 mm. There results exceptionally high yarn advance speeds and a particularly good vortexing of the yarn.

30 Claims, 2 Drawing Sheets

MEANS FOR THE INTERLACING OF YARN

FIELD OF THE INVENTION

This invention relates to a means for voretxing for the interlacing multifilament yarns.

THE RELATED ART

Texturized yarns are understood to be yarns made bulky in any suitable manner, e.g. by means of false twist texturization, swelling chamber texturization, edging texturization etc. The texturization can also be achieved by curling of the filaments.

The interlacing, intermingling or tangling of yarns has the purpose of improving cohesion of the multi-filament yarn in question, and thus its further processability. In this case, the single multifilament yarn preferably consisting of thermoplastic material, as it nears the interlacing means, is still untwisted or has only little protective twist, which yields insufficient cohesion of the filaments for further processing. The multifilament yarn receives the necessary cohesion only through the interlacing of its filaments. The filaments of several multifilament yarns can, if required, be twisted together into a single multifilament yarn in a yarn channel, into which they enter together.

Interlacing means can preferably be applied to texturizing machines, but also to other machines and arrangements, e.g. stretch yarn or spooling machines, or can be operated independently.

In a known interlacing means of this type (U.S. 4,069,565), which is used for the tangling or intermingling of previously false twisted and thus texturized multifilament yarns, the yarn is led by means of yarn guides arrayed at a distance from the entrance and exit opening of the yarn channel. This is conducted in such manner that the yarn extends through the yarn channel in its longitudinal central axis parallel to its longitudinal direction and thus with all-around distance from the circumferential wall of the yarn channel. Alternatively the yarn is guided crossing the yarn channel obliquely in such manner that it contacts only the entrance and exit opening. In yarns produced by such interlacing means, there exist between the relatively short interlaced stretches longer, nontangled stretches which in the case of texturized yarns are bulky stretches. For further processing of the interlaced yarns the best possible cohesion of the filaments of the yarn is desired. Advantageously the nontangled stretches are not overly long and if possible exhibit approximately equal lengths. However, in the yarn there occurs frequently, in addition to the desired, relatively short nontangled stretches, other nontangled stretches several times the length of the shorter nontangled stretches. Thereby large differences in the cohesion of the filaments arise, so that the filament cohesion of the yarn is not particularly good. In the German technical language is has become usage to designate the cohesion of the filaments with "Fadenschluss" or in English, cohesion.

In the known arrangements of this type, only relatively low yarn advance velocities are attainable, because at higher yarn advance velocities, irregular advance of the yarn significantly impairs interlacing. However, for further processing of such yarns on weaving, knitting, tufting and other machines and arrangements, it is most of the time important that the filaments of the yarn have good cohesion, which facilitates and improves processing. It was therefore until now necessary to subject twisted multifilament yarns to secondary operations such as post-twisting, twisting, sizing etc. so as to improve the good cohesion necessary for further processing.

High speeds of yarn advance facilitate reduction of production costs. Thus in the case of false-twist texturizing machines, if they have interlacing means, the applicable yarn advance speeds are limited by the interlacing means and not by the means for texturizing the yarns. For example, known interlacing means for texturized yarn permit the attainment of yarn advance speeds of no more than 350 m/min, while the texturizing of the yarns as such could be possible with yarn advance speeds of e.g. 400 to 1000 m/min and more.

It is therefore an object of the invention to provide an improved interlacing means by which interlacing with not very great differences between the center distances of adjacent tangled sections can be achieved with high yarn advance speeds and relatively low consumption of compressed air.

SUMMARY OF THE INVENTION

Interlacing means for interlacing multifilament yarns are herein provided. These means include a yarn channel having an exit and an entrance at opposite ends of the channel, a yarn guide at a distance adjacent each of the exit and entrance ends, and means for introducing a directed stream of compressed air into the channel to interlace the filaments of the yarns with one another passing through the channel. Therethrough yarn is positioned within the channel extending parallel to a longitudinal direction of the channel and upon entering and exiting the channel will experience a change in direction of less than 90°.

These interlacing means in the sense of the invention yield better coherence of the filaments of the yarns by vortexing. Especially high yarn advance speeds and relatively low consumption of compressed air are also achieved together with all the advantages resulting therefrom, such as cost reduction, avoidance of secondary processing of the yarns so as to increase yarn coherence, better processeability of the yarns by weaving, tufting, knitting etc.

In testing interlacing means according to the examples of the invention, yarn advance speeds of 400 to 2500 m/min were attained without difficulty. The coherence of the twisted multifilament yarns was very good. It was possible to reduce the appearance of undesired overlong noninterlaced lengths considerably, so that almost all noninterlaced lengths had about the same extent which was not excessive extent. In these tests the twisted lengths, especially in the case of texturized yarns, appeared almost periodically, that is at almost equal distances from center to center, which is very beneficial for coherence of the yarn, and thus for further processing of the interlaced yarn. These advantages are not achieved by using known interlacing means of this type. Means according to the invention are particularly suited to the interlacing of texturized multifilament yarns, which may then be arrayed preferably in texturizing machines after, in the direction of yarn travel, their texturizing means.

The interlacing means according to the invention can however also serve for the interlacing of the filaments of smooth multifilament yarns, which are not texturized. It is thereby normally appropriate to make the angles which the straight sections of the yarn located between the yarn guides and the yarn channel enclose with the adjacent sections located outside the geometric longitudinal axis of the yarn channel, smaller than in the case of texturized multifilament yarns, preferrably 15° max., particularly advantageous from about 1° to 10°. It is even possible to use extremely high yarn advance speeds, e.g. about 6000 m/min. At such extremely high yarn advance speeds, the distances between the twisted sections of the multifilament yarn in question become greater but, at least in many cases, such good coherence of the filaments is attained that such interlaced multifilament yarns can be removed without problems from the bobbins upon which they have been wound.

Especially in the case of texturized yarns, relatively high yarn advance speeds and particularly high cohesion can be attained in that in operation, the yarn guides are arrayed at a distance of 3 to 25 mm, preferrably from 15 to 15 mm from the corresponding adjacent aperture of the yarn channel.

It is appropriate that in operation the orientation of the yarn guides with respect to the housing of the interlacing means be retained exactly, when it has been determined to be suitable. In order to attain this in a simple manner without problems, it will be appropriate to array the yarn guides on the housing of the interlacing means. However, this can render more difficult the threading of the yarns into the yarn channel by hand, and introduce the danger that the yarn guides are damaged thereby, or are unintentionally misplaced, and then do not have the desired exact emplacement. In order to reduce this danger, or to obviate it entirely, it is provided in a further development of the invention that the yarn channel is formed jointly by a bottom section and a top section of the housing of the interlacing means which extends over the entire length of the yarn channel and which can be lifted therefrom in order to open the yarn channel. Thereby the clear interior space of the yarn channel is formed by a straigt groove in the bottom section and/or a straight groove in the top section. In this manner, yarns can be inserted into the open yarn channel without problem, without the danger of unintentional displacement of the yarn guides.

It is particularly advantageous to provide that the yarn guides are so arranged that—as measured when the yarn is taut and the air supply to the blow nozzle or nozzles of the yarn channel is shut off—the yarn experiences, as it enters or exits the yarn channel, such change in direction ($\alpha$, $\beta$) that the straight yarn sections located between the yarn guides and the yarn channel distance themselves from the nearest compressed air stream in direction of the corresponding yarn guide once the air supply is actuated. At least in the case of a circularly cylindrical yarn channel, this can be achieved in that the changes in direction of the yarn mentioned ($\alpha$,$\beta$) are larger than half the aperture angle ($\rho/2$) of the compressed air streams issuing from the yarn channel. In general this can be accomplished in that the diffusion angles ($\phi$) of the compressed air streams adjacent to these yarn sections are smaller than said changes of direction ($\alpha$,$\beta$) of the yarn. It will be particularly useful to provide that the yarn guides for the guidance of the multifilament yarn exhibit yokes open toward the bottom, which are held to the upper section by means of brackets and are arrayed preferrably so that they can press the multifilament yarn onto the portion of the yarn channel located in the bottom section. Thereby the yarn can automatically enter into the yarn guides, and exit from them upon reopening of the housing, which greatly simplifies servicing.

Preferably only a single blow nozzle can be coordinated to the yarn channel, which makes possible minimum consumption of compressed air. This blow nozzle can suitably empty into the bottom of the yarn channel, that is from below. However, other arrangements are possible. In some cases it can be provided that the blow nozzle opens into the ceiling or a sidewall of the yarn channel, or in exceptional cases several blow nozzles can be allocated to the yarn channel.

The yarn channel can, in a particularly suitable manner have a semi-circular or approximately semi-circular cross section, otherwise however, other cross sections also, e.g. a circular cross section. The latter in particular is preferable with heavy multifilament yarns.

In general it can be provided that in the yarn channel at any one time only a single multifilament yarn is introduced and interlaced. However, it is also possible to introduce several multifilament yarns into the yarn channel side by side and thereby to combine their filaments by interlacing into a single multifilament yarn. In this manner filaments of multifilament yarns of various properties such as receptivity to dyes can be mixed.

It is particularly suitable that the blow angle ($\delta$) of the blow nozzle be an acute angle, preferably from 60° to 89°, especially about 75° to 85°. Preferably the longitudinal axis of the blow nozzle can intersect the axis of the yarn channel. This is advantageous for the fabrication of the upper and lower sections concerned, and also favorable because of technological reasons. The phrase "blow nozzle or the like" is meant to represent any kind of blowing aperture, an outlet for compressed air, a bore or the like, which serves the blowing of a directed stream of compressed air into the yarn channel. To minimize flow losses, the blow nozzle may have a longitudinal entrance section rounded off in trumpet shape, and may be decreasingly tapered, or be shaped in the manner of a venturi. If small flow losses are not important, then the blow nozzle can be formed by a constantly cylindrical channel or otherwise by a blowing channel made for the injection of a directed air stream into the yarn channel or the like.

Preferably, as to multifilament yarns, texturized multifilament yard shall be dealt with.

BRIEF DESCRIPTION OF THE INVENTION

In the drawing, selected embodiments of the invention are illustrated which show:

SPECIFIC DESCRIPTION

DETAILED DISCUSSION

Figure 2:
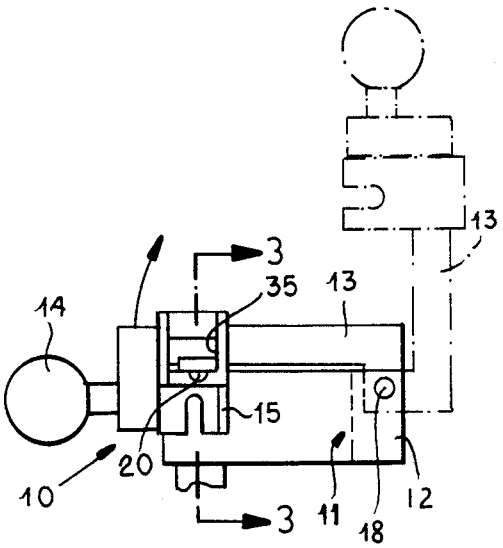
FIG. 2 is a side view of the interlacing means as shown in FIG. 1.

The interlacing means 10 shown has a housing 11, which consists of a rigid bottom section 12 and a rigid top section 13 linked thereto rotatably via a hinge 18, which forms a flap-type lid. The upper section 13 can be tilted up by means of a handle 14 arranged on its front side from the position shown, where the housing is closed, into the open position shown in dot-dash lines in FIG. 2.

Together, the upper section 13 and the lower section 12 form a straight yarn channel 20 traversing the housing 11. When the upper section 13 is in the closed position shown by solid lines, then the yarn channel 20, in its perimeter, is closed, except at its entrance opening, by the blow nozzle 21 with a constant bore diameter or of a cross section changing in the flow direction, preferably with narrowing clear internal cross section, and open at its entrance opening 31 and its exit opening 32. In order to provide access to this yarn channel 20 so as to insert a multifilament yarn 19 without having to cut it apart, and to retrieve it therefrom, this yarn channel 20 can be opened fully over its entire length by manual, pneumatic or other uptilting of the top section 13.

Furthermore, on the top section 13 there are two angled-off arms 33 of a U-shaped yoke 34 constructed as rigid brackets for two yarn guides 15, 16 fixedly attached to these two arms 33, as shown. These yarn guides 15, 16 are realized as U-shaped yokes always open towards the bottom, which on the upper edges of their interior spaces exhibit guide surfaces 17, 17' for redirecting the multifilament yarn 19. The arms 33 have apertures 35, as wide as possible and extending to the yarn guides 15, 16, so that they and the yarn guides 15, 16 offer to the compressed air streams issuing to both sides form the yarn channel 20 the least possible flow resistance, which has a beneficial effect on the interlacing of the yarn.

Figure 1:
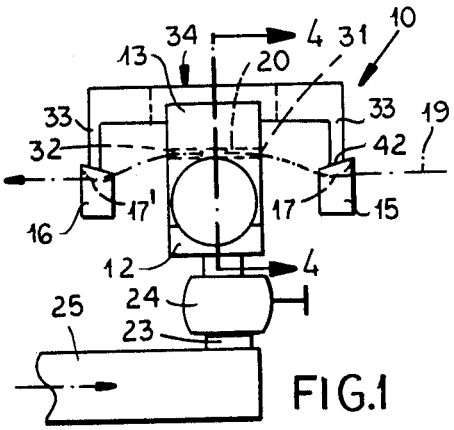
FIG. 1 is a front view of an interlacing means in accordance with an embodiment of the invention.

The multifilament yarn to be interlaced moves towards yarn guide 15 from a stationary yarn delivery means, not shown, approximately horizontally, and there it is guided as shown obliquely upwards into the entrance opening 31 of yarn channel 20, (FIG. 1) then traverses the yarn channel 20, and thereafter moves obliquely downwards to yarn guide 16, and by the latter is again redirected into approximately horizontal direction.

When the supply of compressed air is shut off, this redirection shown has the effect that the multifilament yarn 19 in taut condition in yarn channel 20 lies upon its bottom, in fact approximately along an envelope line of the interior wall of said yarn channel 20 which envelope line intersects the exit opening of the only blow nozzle discharging into the yarn channel, so that the yarn adheres to the yarn channel exit opening even when compressed air supply is shut off. The multifilament yarn 19 entering the vortexing means 10 consists of a plurality or multiplicity of filaments. These filaments can preferably consist of thermoplastic synthetics, e.g. polyamides, polyesters, polypropylene, polyethylene etc.

These multifilament yarns can preferably be texturized yarns.

When passing through the straight yarn channel 20 in the interlacing means 10, the multifilament yarn 19 is acted upon by an intense stream of air, which twists its filaments with one another. For this purpose, the blow nozzle 21 is emplaced in the bottom of the yarn channel 21, whose longitudinal axis 22 is inclined with respect to the longitudinal axis 37 of the straight yarn channel 20 at an acute angle $\delta$. This angle $\delta$ here designated the blow angle; in this embodiment it is about 80° as shown.

Concerning the acute blow angle $\delta$ note that it corresponds to the angle between the yarn section leaving the blow nozzle 21, and the section of the longitudinal axis 22 of the blow nozzle situated above the blow nozzle 21, preferrably $\delta$ is $<90°$.

The yarn channel 20 has a semicircular clear cross section, constant throughout its length. The radius of the semicircle of this cross section can be e.g. about 1 to 4 mm. The ceiling 29 of the yarn channel is level. The blow nozzle 21 enters into the yarn channel 20 in its longitudinal center line from below, opposite the ceiling 29. It is formed by a bore in the bottom section 12 and can also be designated as straight blow channel or the like, which in this embodiment exhibits an initial section rounded in the shape of a trumpet, according to FIG. 3 and 4, which is joined by a cylindrical longitudinal section, which leads as far as the yarn channel 20.

The bottom section 12 is connected to a supply nipple for compressed air 23, which exhibits a manually operable throttle valve 24. This compressed air supply nipple 23 branches off from a main compressed air channel, which is connected to a source of compressed air, not shown. The direction of air flow of blow nozzle 21 is toward the ceiling 29.

The bottom section 12 has on its level top side a gutter or groove 26 of semicircular constant cross section, which forms the clear range of semicircular cross section of the yarn channel 20. This yarn channel 20 is closed off above by a level, horizontal ceiling 29, which is formed by the level underside of a plate 27 fixedly arrayed underneath top section 13. During operation, this plate is exposed to the most wear and can therefore be replaced, without having to replace the entire top section 13.

The straight blow nozzle 21 discharges into the yarn channel 20 from below, which blow nozzle starts on a bottomside channel 30 of the one-piece, rigid bottom section 12 with a trumpet-shaped entrance opening and then continues circularly cylindrical to the yarn channel 20. The longitudinal axis 22 of the rotationally symmetrical blow nozzle 21 falls into the longitudinal axis of symmetry of yarn channel 20, which bisects the longitudinal central plane of ceiling 29

The angles $\alpha$ and $\beta$ which are formed by the longitudinal direction of yarn channel 20 and the entering and exiting sections of the multifilament yarn 19, respectively, can for texturized yarn lie between 10° to 40°, particularly favorable at 15° to 25 °, and for smooth, that is non-texturized yarns suitably at 15° to 25° and for smooth, that is non-texturized yarns preferably 1° to 10°. These angles $\alpha$ and $\beta$ can suitably be measured with compressed air supply shut off, since the yarn may vibrate when the supply of compressed air is open. These angles can also be determined as the angles $\alpha$ and $\beta$ between the straight runs of the yarn 19 from the yarn channel 20 to the yarn guides 15, 16, and the longitudinal direction of the yarn channel. At such angles, the multifilament yarn 19 is laid against the bottomside edges of the entrance and exit openings of yarn channel 20, since it then approaches it obliquely from below, and leaves it to run obliquely downwards.

Thus the yarn 20 can at least as long as compressed air does not impinge on it lie against the floor of the yarn channel 20 which exhibits the exit opening of blow nozzle 21. This is particularly favorable for good interlacing of the multifilament yarn 19.

In operation, compressed air flows from the main channel 25, via connecting nipple 23, into the blow nozzle 21, so that the multifilament yarn 19 traversing the yarn channel 20 is vortexed by the intense stream of blown air exiting from blow nozzle 21. Excellent interlacing of the yarn 19 is thus achieved.

In this embodiment, the clear interior space of the yarn channel 20 is formed by a groove 26 let into the bottom section 12. It is, however, possible to form this clear interior space at least partly by a groove formed in the top section 13.

In this embodiment, the top section 13 is pivotably linked to the bottom section 12 so that it can be lifted off bottom section 12 to uncover the yarn channel 20 over its full length. The capability of being lifted off can also be effected by different means. For example, the top section can be suitably connected by means of a straight-line mechanism or a parallel guide with the bottom section, or connected thereto in different manner, or it can be removed manually.

As shown, the top section 13 is furthermore made symmetrical to its longitudinal central plane which intersects the yarn channel 20 at right angles.

The top section 13 is held in its closed position by a detent 38 cooperating with bottom section 12. The resistance of this detent is overcome upon tilting up, and reclosing of top part 13. The axis of rotation of top section 13 runs parallel to yarn channel 20. Thus the multifilament yarn lying tautly in the groove becomes optimally accessible in its full length when the top section 13 is tilted up, since the two yarn guides 15 and 16 are moved up together with the top section 13, with which they are immovably connected. Thereupon the multifilament yarn can be lifted out of the groove 26 of the bottom section 12 without cutting it, and then it or another multifilament yarn can be put back into the groove. Upon rotating down of the top section 13, the two yarn guides 15, 16 engage automatically the newly inserted multifilament yarn 19 and the yarn channel 20 is then reclosed circumferentially and the vortexing means is again ready to operate.

Streams of compressed air issuing in operation from the entrance and exit openings of the yarn channel should not undergo much flow resistance by the yarn guides and their supports. For this purpose there are wide apertures 35 in arms 33 and the yoke-shaped yarn guides 15 and 16 are relatively small. A further measure, advantageous in this regard, can consist of arraying at least one air guide baffle outside the yarn channel at a distance from its entrance opening and/or exit opening, for the purpose of deflecting the streams of compressed air issuing from the yarn channel away from the path of the yarn. This is realized in that the yarn guides, on their outsides, are provided with obliquely oriented surfaces 42, 43, in the manner that these surfaces deflect the streams of compressed air obliquely downwards from the path of the yarn. The vortexing is thereby further improved, and the coherence of the yarn is accordingly further increased. It can also be provided for this purpose, that the brackets have air deflecting surfaces for the deflection of the compressed air streams from the yarn, or that separate air deflecting surfaces are provided on them.

The length of the yarn channel 20 can preferably be set at 10 to 28 mm for texturized yarns.

In accordance with the invention, vortexing means can operate with low consumption of compressed air.

Figure 7:
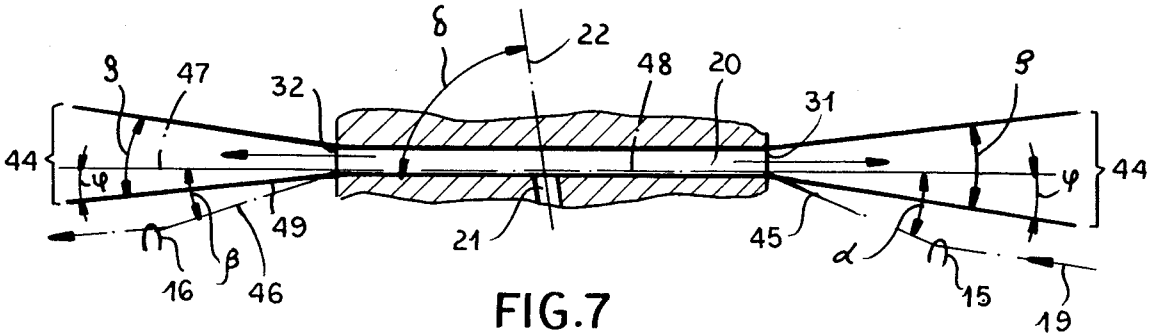
FIG. 7 is a longitudinal section through a yarn channel according to the invention.

FIG. 7 shows is shown a section through a circularly cylindrical yarn channel. Its only blow nozzle exhibits the acute blow angle $\delta$. Compressed air issuing during operation produces compressed air streams 44 issuing freely from the two openings 31, 32 of yarn channel 20, whose aperture angle shall be designated $\rho$. For free air streams, $\rho$ will be approximately 14° to 16°. The angles $\alpha$, $\beta$ of the change of yarn direction at the entrance and exit of the yarn 19 into and out of the yarn channel 20, respectively, can suitably be greater than $\rho/2$, preferrably greater than 7° to 8°. Preferrably, they can be greater than 9°. Thereby, the compressed air streams 44 do not adversely affect the run of the yarn 19 outside of the yarn channel, to which, if required, an embodiment of the yarn guides 15, 16 and or their brackets 33 in a manner offering little air resistance can contribute suitably, which if necessary they are required to do if they offer disturbing resistance to the streaming of air streams 44.

SPECIFIC EXAMPLE

Several examples are presented below providing test data using vortexing means similar to the embodiment according to FIGS. 1 to 6.

EXAMPLE 1

The length of the yarn channel was 15 mm. Radius of the semicircular cross section of the yarn channel was 1.5 mm and the diameter of the blow nozzle at its exit opening 1.3 mm. The blow angle $\delta$ was 80°. Angles $\alpha$ and $\beta$ were 20° each. A yarn was vortexed which consisted of 36 polyester filaments. It was texturized by false twisting. Linear density of the yarn was 55 dtex. The yarn advance speed during interlacing was 620 m/min. Consumption of compressed air was 2 to 4 $Nm^3/h$. After the yarn was interlaced yarn, examination indicated that the number of interlaced spots in the yarn was about 140. The length of each interlaced spot was about 2 mm. Noninterlaced spots or ranges of the yarn all had essentially the same length of about 5 mm. The interlaced and noninterlaced spots thus resulted in a yarn with almost periodic character of the interlacing. $Nm^3$ is the cubic meter and standard conditions.

EXAMPLE 2

The interlacing means had the same dimension and measurements as in Example 1, with the following differences: the exit opening of the blow nozzle had a diameter of 1.5 mm. A texturized polyester yarn of a linear density of 167 dtex was examined, which consisted of 32 filaments. Two such yarns were fed to the interlacing means simultaneously, so that the composite yarn resulting from the interlacing of these two yarns had a linear density of 334 dtex. The speed of yarn advance was 620 m/min. Consumption of compressed air was about 8 $Nm^3/h$. The interlaced yarn had about 100 interlaced places per meter. interlacing was again nearly periodical. The interlaced places had a length of about 3 mm, and the noninterlaced places of about 7 mm.

EXAMPLE 3

The length of the yarn channel was about 25 mm. The yarn channel had, as opposed to the previous illustrating the invention, a examples circular diameter of 5 mm. The exit opening of the blow nozzle had a diameter of 3.3 mm. Angles $\alpha$ and $\beta$ were about 20°. The distance of the yarn guides from the yarn channel openings was about 15 mm. A texturized polyamide yarn of 1300 dtex was vortexed. The speed of advance was 1800 m/min. This yarn was texturized at a distance ahead of the interlacing means in a swelling chamber process. There resulted about 35 to 40 texturized spots per meter. The individual interlacing spot had an individual length of about 5 mm. Noninterlaced sections had lengths of about 20 mm. This yarn also had a nearly periodic interlaced character. The air consumption amounted to 20 to 25 $Nm^3/h$ As to examples 1 and 2, it should be noted that the yarn guides had distances from adjacent openings of the yarn channel of about 7 mm.

As to FIG. 7, the following is noted:

In order that the yarn sections 45, 46 of the yarn 19 located between the yarn guides 15, 16 do not come into the compressed air streams 44, which would mostly be unfavorable, the angles $\alpha$, $\beta$ can suitably be greater than $\rho/2$. At a circular clear cross section of yarn channel 20, the compressed air streams 44 expand in cone shape and the expansion angles $\phi$ adjacent to yarn sections 45, 46 equal $\rho/2$. It happens now that for random clear cross sections of yarn channel 20, e.g. for semi-circular cross sections accordingly, it will be appropriate for texturized and untexturized yarns to provide that the changes in direction $\alpha$, $\beta$ of the yarns 19 at entering and exiting respectively the yarn channel 20 are greater than the expansion angles of the compressed air stream adjacent to the yarn sections 45, 46, since then too these yarn sections 45, 46 move away from these compressed air streams in direction towards the yarn guides 15, 16. These expansion angles $\phi$ correspond to the angles between the lines 47 and 49. The lines 47 are straight geometric extensions of the envelope line 48 of the yarn channel which falls into the plane of the drawing, to which the yarn adheres when the compressed air supply is shut off. The lines 49 correspond to the stream boundaries of the compressed air streams 44 adjacent to yarn sections 45, 46.

The angles $\alpha$, $\beta$ correspond as shown to the angles between lines 45 and 47, and lines 46 and 47, respectively.

Suitably, positional adjustability of yarn guides 15, 16 can be provided, so as to be able to modify these angles $\alpha$, $\beta$ and, depending on the interlacing intensity desired, to adjust them differently.

Figure 3:
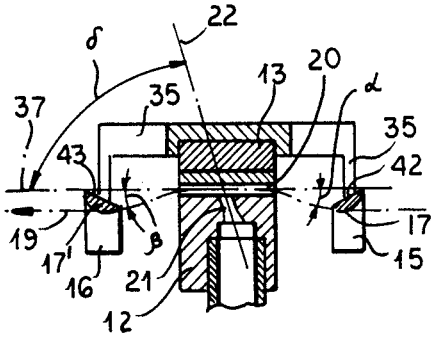
FIG. 3 is a section through the arrangement according to FIG. 1 along section line 3—3.
Figure 4:
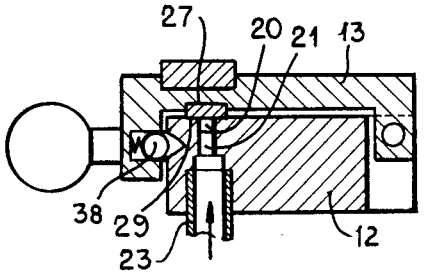
FIG. 4 is a section through the arrangement according to FIG. 2, along section line 4—4.
Figure 5:
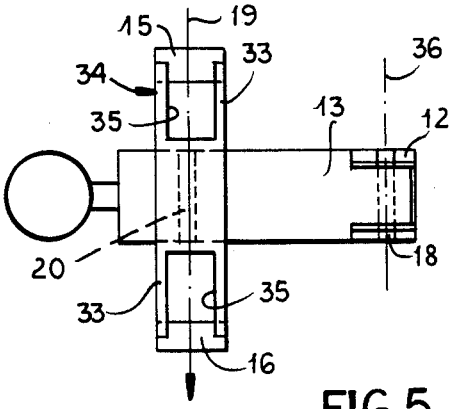
FIG. 5 is a top view of the arrangement according to FIGS. 1 and 2.
Figure 6:
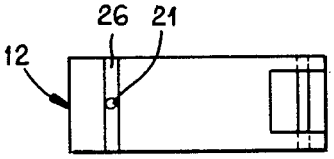
FIG. 6 is a top view of the lower part of the arrangement according to FIGS. 1 and 2.
Figure 8:
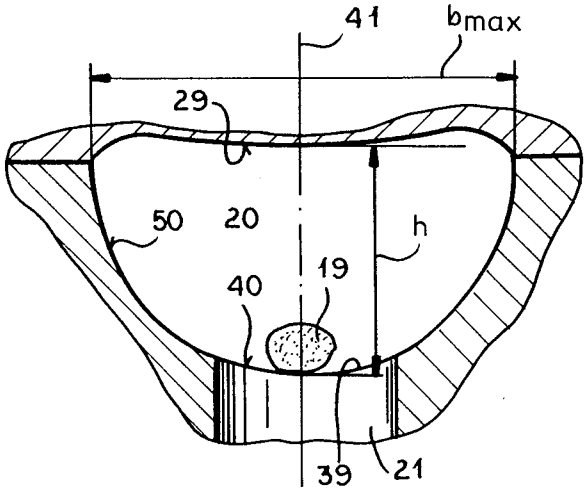
FIG. 8 is a cross section through a yarn channel according to the invention.

In FIG. 8, a cross section through a yarn channel 20 is shown. The blow nozzle 21 which blows air into it for the vortexing of one or more multifilament yarns is shown partially. The section is so located that the section plane bisects the exit opening of blow nozzle 21. Furthermore, 41 designates the longitudinal plane of yarn channel 20 lying perpendicular to the plane of the drawing which can suitably be a plane of symmetry of yarn channel 20 as well as of the blow nozzle 21 which is formed by a bore, which as shown in FIG. 3 or 4 can preferrably have an initial longitudinal section, not shown, rounded off in trumpet shape. The yarn channel 20 is straight and exhibits preferrably over its entire length, or essentially over its entire length, a constant cross section. Most of the time it will be suitable to keep this cross section constant, except for somewhat rounded or broken edges of the entrance and exit opening to burr the edges of yarn channel 20. Exit opening 40 of blow nozzle 20 lies approximately halfway in the length of yarn channel 20, so that it is equidistant from its entrance and exit opening, which is suitable. Blow nozzle 21 is inclined towards the longitudinal axis of the yarn channel under a blow angle of less than 90°.

The cross section of the blow nozzle can preferably be circular, where however the edge 39 of exit opening 40 comes out as non-circular, which is caused by the rounding of the wall of the yarn channel at this exit opening 40 and the acute blow angle.

The cross section of yarn channel is essentially semicircular, where the exit opening 40 of blow nozzle 21 lies as shown in the center of the approximately semicircular wall section of yarn channel 20, which is extremely appropriate for good vortexing of the multifilament yarns. The contour of the yarn channel 20 is composed of an approximate semicircle 20 and the contour of the ceiling 29 of yarn channel 20 lying opposite blow nozzle 21, which as shown has a flat, convexely arched center portion, which merges via flat concave roundings into the semicircular contour line 50.

The distance h of the edge 39 of the exit opening 40 of blow nozzle 21 from the wall surface or ceiling 26 lying diametrically opposite to this exit opening 40 in the geometric longitudinal central plane 40 which bisects the exit opening of blow nozzle 41 can preferrably measure maximally 6 mm, preferrably maximally 2 mm. Since the yarn channel 20 exhibits over its length, or almost over its length, a constant clear cross section, then h is accordingly constant over the length, or nearly over the length of yarn channel 20.

The ratio $h/b_{max}$ of this distance h to the maximal width $b_{max}$ measured perpendicular thereto of yarn channel 21 is in this example of execution about 0.54.

In general, the ratio $h/b_{max}$ for random cross sections of the yarn channel can be preferably a maximum of, 1.0 preferably 0.9 at a maximum, particularly preferred being a maximum of 0.6 maximal, and/or a minimum of 0.3, preferably a minimum of 0.4, which for the preferred boundary values for h given above makes it possible to achieve very good interlacing of multifilament yarns, high speeds of yarn travel, comparatively uniform distances between interlaced yarn sections, and interlaced yarn sections of relatively short length, so that even relatively large numbers of interlaced sections can be attained per running meter of yarn length. Thereby one can vary the number of interlaced sections per meter of yarn length within wide limits by means of the pressure with which the preferably single air stream is blown into the yarn channel by the blow nozzle, thus by its insertion velocity.

Preferably, only a single blow nozzle is coordinated to the yarn channel, which is favorable for interlacing, and holds the consumption of compressed air to a minimum. The yarn interlacing means according to the invention has the advantage that it can operate with relatively small consumption of compressed air.

It will be particularly appropriate to provide that the multifilament yarn 19 is so guided that it—in taut condition at closed supply of compressed air—adheres to an envelope line of the interior wall of the yarn channel, which crossed the exit opening 40 of the blow nozzle approximately diametrically, in a manner that the multifilament yarn thereby lies on the margin 39 of the exit opening 40 of the blow nozzle 21 so as to cross this exit opening 40 approximately diametrically.

It is further favorable for interlacing if, as preferred, it is provided that the yarn channel is about 8 to 40 mm, preferrably 10 to 30 mm long.

The blow nozzles 21 shown blow the compressed air streams into the yarn channels 20 at subsonic velocity, which is preferrably provided, or can be provided. It is also possible that the blow nozzles are realized as Laval nozzles, which can blow the compressed air streams into the yarn channels at supersonic velocities.

We claim:

1. Interlacing means for interlacing multifilament yarns comprising:

a yarn channel having an exit and an entrance at opposite ends of said channel;

a yarn guide at a distance adjacent each of said exit and entrance ends;

means including at least one blow nozzle for introducing a directed stream of compressed air into said channel for interlacing the filaments of a yarn passing through said channel with one another; and wherein said yarn is positioned within said channel to extend generally in a longitudinal direction of said channel so as to be on a rim of an exit opening of said blow nozzle, said yarn guides being so positioned that the yarn, measured in taut condition and with the compressed air supply shut off, both upon entering and exiting said channel experiences a change in direction of at least an 8° angle but less than 90°, and said blow nozzle is oriented to intersect said yarn channel at a blow angle of less than 90°.

2. Interlacing means according to claim 1 wherein said distance of the yarn guides from their adjacent channel ends being maximally 30 mm, said yarn channel having a longitudinal length maximally 40 mm for untexturized multifilament yarns and 30 mm for texturized yarns.

3. Interlacing means according to claim 2 wherein the blow angle is between 60° and 89°.

4. Interlacing means according to claim 1 wherein said distance of said yarn guides from said channel at each end ranges from 3 to 25 mm, said yarn guides being positioned movably.

5. Interlacing means according to claim 1 further comprising brackets each having apertures for allowing passage of said compressed air issuing from said yarn channel, said yarn guides being arranged on said brackets.

6. Interlacing means according to claim 1 wherein said yarn guides are so positioned that the yarn, measured in taut condition and with the compressed air supply shut off, upon entering or exiting the yarn channel experiences a change of direction of at least an 8° angle for texturized yarn and maximally 15° for smooth yarn.

7. Interlacing means according to claim 1 wherein said yarn guides are for textured yarn so positioned that the yarn, measured in taut condition and with the compressed air supply shut off, upon entering and exiting the yarn channel experiences a change of direction of from 10° to 40°.

8. Interlacing means according to claim 1 wherein said yarn guides are arranged on a housing containing said yarn channel.

9. Interlacing means according to claim 8 wherein said housing of said yarn channel comprises a bottom and a top section, said top section being liftable therefrom over an entire length of the yarn channel, a straight groove being formed in at least one of said bottom and top sections defining said yarn channel.

10. Interlacing means according to claim 9 wherein a hinge pivotally connects said top and bottom sections.

11. Interlacing means according to claim 9 wherein the yarn guides are rigidly connected to the top section.

12. Interlacing means according to claim 9 wherein a clear cross-section of said yarn channel is approximately semicircular and formed as said groove in said bottom section and said channel bounded on a top side thereof by a level yarn channel ceiling formed by said top section.

13. Interlacing means according to claim 1 wherein said yarn guides are U-shaped downwardly opening yokes, said yokes being attached by brackets.

14. Interlacing means according to claim 1 wherein said yarn guides have at least one air deflecting surface arrayed to deflect away from a travel path of said yarn the compressed air stream issuing from the yarn channel.

15. Interlacing means according to claim 1 wherein said blow nozzle opens into the yarn channel approximately opposite from an approximately level channel ceiling thereby directing said air stream onto said ceiling.

16. Interlacing means according to claim 1 wherein the yarn channel is approximately 8 to 40 mm long.

17. Interlacing means according to claim 1 wherein said blow nozzle is positioned at approximately equal distance from said entrance and exit ends of said yarn channel.

18. Interlacing means according to claim 1 wherein said means for introducing compressed air is a single blow nozzle.

19. Interlacing means according to claim 1 wherein said yarn channel maintains an approximate constant cross section along a length thereof.

20. Interlacing means according to claim 1 wherein said yarn channel has a semicircular cross section.

21. Interlacing means according to claim 1 wherein the yarn guides are so positioned that any changes in direction which the yarn experiences upon entering and exiting the yarn channel as measured in taut condition and with compressed air supply shut off are larger than an adjacent angle of diffusion of the compressed air stream exiting from the yarn channel when the compressed air supply is turned on again.

22. Interlacing means according to claim 1 wherein said blow nozzle is provided with an exit opening having a rim, a distance h measured from said rim to an inner surface of said yarn channel lying opposite said exit opening as measured along a geometric longitudinal central plane of the yarn channel bisecting the exit opening, being a maximum of 6 mm, the maximum ratio of the distance h to a maximum width $b_{max}$ of the yarn channel measured perpendicular to said distance in a common cross sectional plane thereof being 1 mm.

23. Interlacing means according to claim 1 wherein said blow nozzle has a constant cross section along its entire length.

24. Interlacing means as defined in claim 1 wherein said yarn guide is adjustable as to its position.

25. Interlacing means as defined in claim 1 wherein said blow nozzle generates a blowing angle for the compressed air of at least 75°.

26. Interlacing means as defined in claim 1 wherein said blow nozzle has a longitudinal axis intersecting a longitudinal axis of said yarn channel.

27. Interlacing means as defined in claim 1 wherein said yarn channel has a generally round cross section.

28. Interlacing means as defined in claim 1 wherein said yarn channel has a generally nonround cross section.

29. Interlacing means as defined in claim 1 wherein said yarn channel has an approximately semicircular cross section.

30. Interlacing means as defined in claim 1 wherein said yarn channel is so constructed and arranged that, in a taut condition of said yarn with supply of compressed air terminated, said yarn crosses diametrically an exit opening of said blow nozzle.

* * * * *